United States Patent [19]

Bangyan

[11] Patent Number: 4,816,083

[45] Date of Patent: Mar. 28, 1989

[54] MULTIFUNCTIONAL ELECTROMAGNETIC VALVE ASSEMBLY

[76] Inventor: Wen Bangyan, 21 Fengshou Lane, Ruian, Zhejing, PRC, China

[21] Appl. No.: 857,102

[22] Filed: Apr. 29, 1986

[30] Foreign Application Priority Data

Apr. 29, 1985 [CN] China ..... 85103856

[51] Int. Cl.[4] ..... F16K 31/383

[52] U.S. Cl. ..... 137/271; 137/594; 137/599; 137/606; 137/614.2; 137/883; 251/14; 251/30.02; 251/33

[58] Field of Search ..... 251/42, 43, 30.02, 33, 251/128, 14; 137/523, 614.2, 606, 495, 594, 595, 533.31, 489, 543.23, 543.21, 523, 271, 487.5, 599, 315, 329.1, 883

[56] References Cited

U.S. PATENT DOCUMENTS

| | | | |
|---|---|---|---|
| 912,073 | 2/1909 | Christenson | 137/329.1 |
| 1,349,594 | 8/1920 | Wafer et al. | 137/315 |
| 1,375,497 | 4/1921 | Eickman | 137/523 |
| 1,675,082 | 6/1928 | Aular | 137/543.23. |
| 2,479,620 | 8/1949 | Ingham | 137/523 |
| 2,664,916 | 1/1954 | Conley | 251/30.02 X |
| 2,969,088 | 1/1961 | Kramer | 137/614.2 |
| 3,477,466 | 11/1969 | Sturm | 251/30.02 X |
| 3,593,741 | 7/1971 | Odenthal et al. | 137/495 |
| 3,934,816 | 1/1976 | Terrell et al. | 251/314 |
| 4,058,287 | 11/1977 | Fromfield | 251/33 X |
| 4,129,144 | 12/1978 | Andersson et al. | 137/543.21 X |
| 4,330,004 | 5/1982 | Yano et al. | 137/343 |

FOREIGN PATENT DOCUMENTS

| | | | |
|---|---|---|---|
| 662170 | 8/1929 | France | 137/594 |

*Primary Examiner*—Martin P. Schwadron
*Assistant Examiner*—Stephen M. Hepperle
*Attorney, Agent, or Firm*—Birch, Stewart, Kolasch, & Birch

[57] ABSTRACT

A multi-function electromagnetic valve assembly is provided which combines a number of housing combinations of electromagnetic valves into a single housing or connects the valves such that the valve inlets and/or exits are separate and/or merged to form a variety of combinations. Each of the electromagnetic valves in the assembly may have a manual operation unit and a one-way valve piston incorporated to have functions, such as manual operation in addition to automatic operation, one-way function and adjustable opening height of the valve. The use of a lot of manual valves and one-way valves can be avoided by using the present valve assembly. For the pilot type electromagnetic valve, a throttling mechanism can also be incorporated in the assembly and thus, the electromagnetic valves can compensate for wear of the valve, can adjust operating time, can operate with different media having different viscosity and can be isolated from other valves.

12 Claims, 9 Drawing Sheets

MULTIFUNCTIONAL ELECTROMAGNETIC VALVE ASSEMBLY

BACKGROUND OF THE INVENTION

This invention relates to a new type of electromagnetic valve, in particular to a multifunctional electromagnetic valve assembly for industrial applications.

DESCRIPTION OF THE BACKGROUND ART

Electromagnetic valves are often used in an automatic control system as an operating unit. In order to ensure that a system as an operating unit. In order to ensure that a system can still work normally and control the flow of material in case of a power failure or in the case of the electromagnetic valve being out of order, the method conventionally used in the prior art is to add a manual by-pass valve to the system. Moreover, in order to maintain and repair the electromagnetic valve during contained operation of the control system, two manual valves are added downstream and upstream of the electromagnetic valve. Thus, in the prior art system, there is a requirement for three manual valves, resulting in high cost and a requirement for a large area for the control system.

An automatic control system usually requires a number of electromagnetic valves. In the prior art, many separate electromagnetic valves are adopted to the system and three additional manual valves are required for each electromagnetic valve. If the fluid pressure in the pipe in which the flow is to be controlled is connected to another pipe in which the pressure may rise above the pressure of the flow controlled pipe, a one-way valve is utilized to replace the manual valve which is downstream and serially connected with the electromagnetic valve to prevent the back flow in the pipe. Thus, the prior art system comprises of electromagnetic valves, manual valves and one-way valves resulting in a very complicated pipe system. Nevertheless, because of different uses, the pipe system is formed of different combinations of inlet and exit pipes, such as separate inlets and exits from each other with separate control, separate inlets and co-exit flow with separate control, control system with co-inlet and separate exits with separate control in application of flow-ratio distribution and the system with merged exits and inlets. These different combinations need quite a lot of connectors with a particular way to connect them, which not only causes inconvenience in fitting on and removing the pipes, but also is prone to leakage.

Further, the configuration parameters of each electromagnetic valve according to the prior art are determined by the media viscosity during design and those designed electromagnetic valves are not exchangeable due to their different configuration parameters.

Also, during an operating time period from receiving a command to completely opening or closing prior art valves, these valves are usually not adjustable. In order to get a certain time delay, a damper is provided, resulting in a complicated configuration and high cost.

Moreover, the open height of the electromagnetic valve in the prior art is not adjustable either. As a result in the prior art, quite a lot of electromagnetic valves have to be adopted in the control system, which results in a series of inconveniences in manufacturing, purchasing, assembling and storing, and is likely to cause more mistakes and cost more.

U.S. Pat. No. 4,330,004, issued by the U.S. Patent and Trademark Office on May 18th of 1982, provides a special carrier on which many electromagnetic valves are fixed. The inlets and/or exits of the pipe system may be arranged in different combinations. This approach had many advantages over the prior art, but it did not overcome all the problems mentioned above.

SUMMARY OF THE INVENTION

An object of the presentn invention is to provide a kind of electromagnetic valve which not only can provide complete manual functioning to open or close the valve, but also would not interfere with the autofunction of the electromagnetic mechanism, and would not deteriorate electromagentic performance.

Further, the purpose of the invention is to provide an electromagnetic valve which is capable of separating the pilot valve from the main valve.

A further object of the invention is to make the operating time of the electromagnetic valve, the valve open height and the suitability range to different media viscosity adjustable and to make the electromagnetic valve able to compensate for wear of the main valve.

Still another object of the present invention is to provide the electromagnetic valve with the capability of functioning as a one-way valve.

Still a further object of the invention is to provide a valve arrangement adaptable to a variety of combinations, which is simple and flexible for forming a variety of pipe systems, and in which the number of pipe connectors required can be greatly reduced.

An additional object of the invention is to overcome the problems mentioned above in the prior art, and to provide a kind of multi-function electromagnetic valve assembly to reduce the quantity of components used in an automatic control system and consequently reduce the time needed for installation and maintenance, to reduce the needed area and cost, and to increase the reliability of the system. T6e multi-function electromagnetic valve assembly in the present invention is able to make the working parameter of the assembly adjustable in order to be very flexible in use.

The features of the present invention include the following:

1. Combine all the valve housing into a single housing or connect them together, and make the valve inlets and/or exits separate and/or merged to form a variety of combinations, such as, with a single valve housing with separate valve inlets and exits to form a multi-pass combination with separate control; separate valve inlets and co-exit to form another combination with separate control; a co-inlet and separate exits to form other combinations for controlling the flow rate distribution; a co-inlet and co-exit to form the control system adopted to different flow rates.

2. The above mentioned different combinations can be arranged by variations in combining connection members at inlets and exits without changing the valve housing and passage. This is to say, the housing of the electromagnetic valve assembly according to the present invention does not necessarily have permanently fixed connection parts to connect to respective pipes, and thus the connection members in the assembly at exit and inlet are provided as separate units from the housing and can be made changeable and removable. The connection members at the inlet or exit in the assembly have their own particular passage structure within a single body. The connection part may have a different passage structure. For example, one kind of structure is of separate passages and another kind is of merged passages. Thus, the same valve with two kinds of connection members may form four different combinations.

3. A manual drive valve mechanism may be incorporated in the assembly. The assembly has a threaded rod, which center line is in the same direction as the valve piston moving direction, fixed on the housing cover of the assembly. The operating part may be connected with the threaded rod or it is simply a manufactured part on the threaded rod. A valve piston rod may be arranged to go through the inner hole of the threaded rod permitting their relative motion. The valve piston rod has a location limit part, or it is connected with a location limit member. The piston rod moving distance allowed relative to the threaded rod may be equal to or a little bit larger than the rated valve piston moving distance. Such an electromagnetic valve assembly comprising a manual mechanism is capable of providing the force needed to get the valve open or close without deteriorating any electromagnetic performance, so that manual by-pass valve can be saved by such an arrangement according to the present invention. Further, it also provides adjustment of the moving distance (valve open area) of valve piston under electromagnetic force, resulting in improving the life-time and stability of the system.

4. One-way valve can be incorporated in the assembly of the invention. The one-way valve may make use of the exit side of the assembly as a one-way valve seating. The assembly may have a one-way valve piston facing the valve seating. In this way, the separate one-way valve downstream serially connected to the electromagnetic valve in prior art designs can be avoided. The one-way valve incorporated in the assembly further can be designed to make use of the assembly hole to guide the valve piston and a separate guide element can also be avoided. Thus, the configuration of the assembly is more compact.

5. Throttling mechanism can be incorporated for the pilot type electromagnetic valve, which is provided in the passage between a pilot valve inlet and a back chamber of the main valve. This arrangement may not only compensate for the pressure loss caused by wearing of the main valve piston and improve the compatibility of the main valve with the different viscosity range of the fluid, but also makes the operating time of the electromagnetic valve adjustable. It should also be noted that when necessary, such as during repairs, separating the electromagnetic valve may be easily completed by adjusting the throttling mechanism to the zero flow-ratio position. The manual valves in the prior art which carry out the function of separating the electromagnetic valve from the system can be replaced by this arrangement. When the electromagnetic valve is to be repaired or maintained, the throttling mechanism may be adjusted at zero value for flow rate and a threaded plug may be fixed at the exit of the pilot valve. Thus, the electromagnetic operating unit can be removed, while the flow rate of the media can be controlled by the manual mechanism.

The multi-function electromagnetic valve assembly according to the present invention has the following advantages:

1. Its configuration is compact due to its small size. It provides many desired functions resulting in a reduction of the requirement for manual valves and for one-way valves and can be utilized in a central control system It occupies less area and is easy to connect into a system.

2. It requires less quantity of parts and its parts have very good suitability and exchangeability. With different combinations, it can execute many desired functions. The assembly can be easily mass produced and can cost less.

3. Its operating time and suitability range to different media viscosity are adjustable. Also, both the electromagnetic unit and the manual unit work independently without interfering with each other. In addition, it provides one-way function. Therefore, it has many desired functions and can be widely used.

4. It has the ability for compensating for wear and for allowing separating of the electromagnetic valve from the assembly. The valve's life time is quite long and it is easy to repair and maintain.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
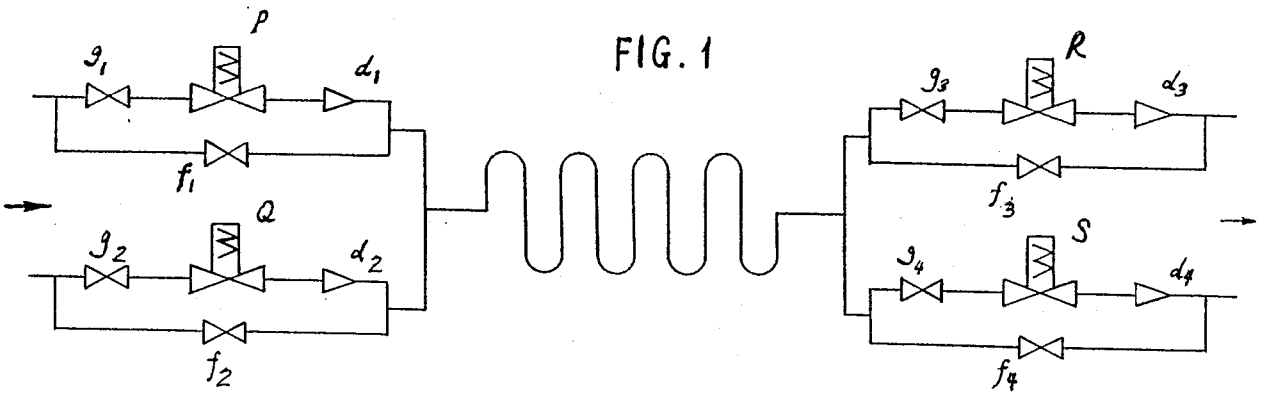
FIG. 1 shows a conventional heat exchanger and pipe system with valves and pipes according to the prior art to control media flow.

The pipe system shown in FIG. 1 is conventionally used in the prior art. When the fluid temperature around the spiral tube of the heat exchanger is lower than a specified low limit, the regulator of the control system will command the electromagnetic valve P to open and allow the steam or hot water to enter into the spiral tube and heat the fluid around the tube. The steam or hot water exiting from the heat exchanger will enter the electromagnetic valve R which is open at the same time with valve P, and then is directed to somewhere else or to a furnace for recycling. Whereas, when the temperature is higher than a specified high limit, the regulator will command the electromagnetic valve Q to open and allow cold water to enter into the spiral tube and cool the fluid around the tube. The cold water exiting from the heat exchanger will enter the electromagnetic valve S which is open at the same time with valve Q, and then is directed to a discharge pipe for recycling.

In order to prevent the hot water or cold water from back flowing caused by a pressure difference between the cold water and hot water in respective supply pipes, one-way valves $d_1$ and $d_2$ are provided downstream of said valves P and Q respectively. Also, in order to prevent back flow between discharge pipes, one-way valves $d_3$ an $d_4$ are provided downstream relative to valves R and S. Moreover, in order that the system can be controlled manually, in case the electrical supply is interrupted or if any of the electromagnetic valves in the system malfunction or if the working pressure difference exceeds a specified value, four by-pass pipes and four manual valves $f_1$, $f_2$, $f_3$, $f_4$ are respectively added to the system. In order to maintain and repair an electromagnetic valve without stopping the operation of the system, four additional manual valves $g_1$, $g_2$, $g_3$, $g_4$ are added to the system upstream of the electromagnetic valves. For this conventional system, four electromagnetic valves, four one-way valves, eight manual valves and the respective pipes and connectors are needed, resulting in a large area being required for this system. With an increasing number of times this system needs to be assembled or disassembled, the greater the possibility of leakage in the system.

Figure 2:
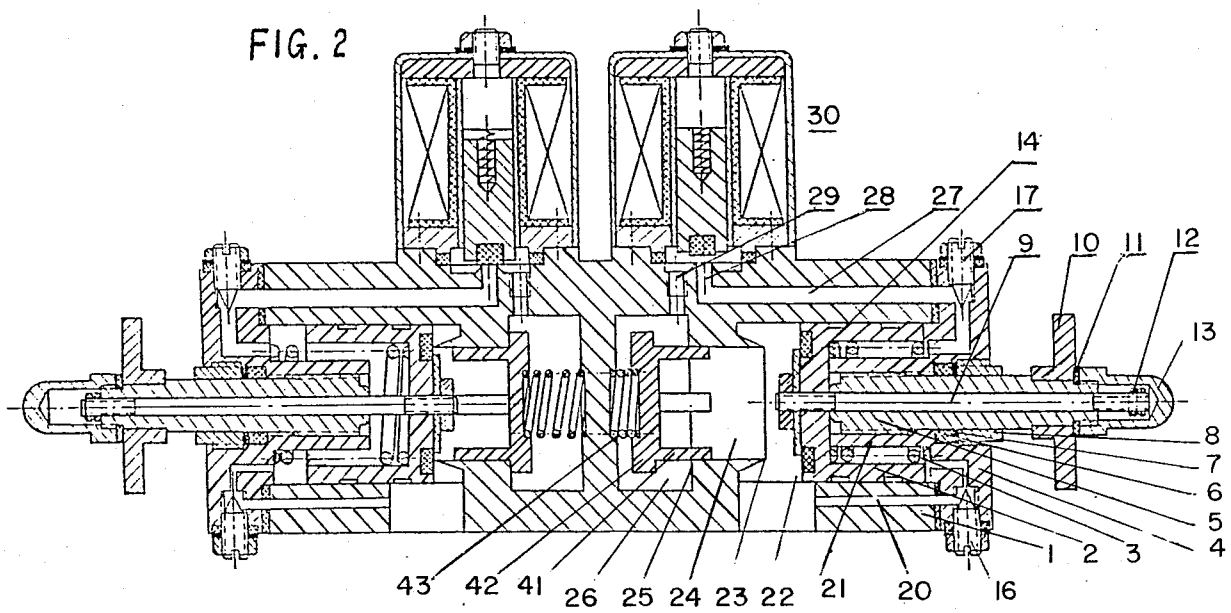
FIG. 2 is a longitudinal section view of the pilot type electromagnetic valve assembly shown in FIGS. 3, 4, 5, and 6 and according to the present invention with two manual units, electromagnetic valves, throttling mechanism and one-way valves.
Figure 3:
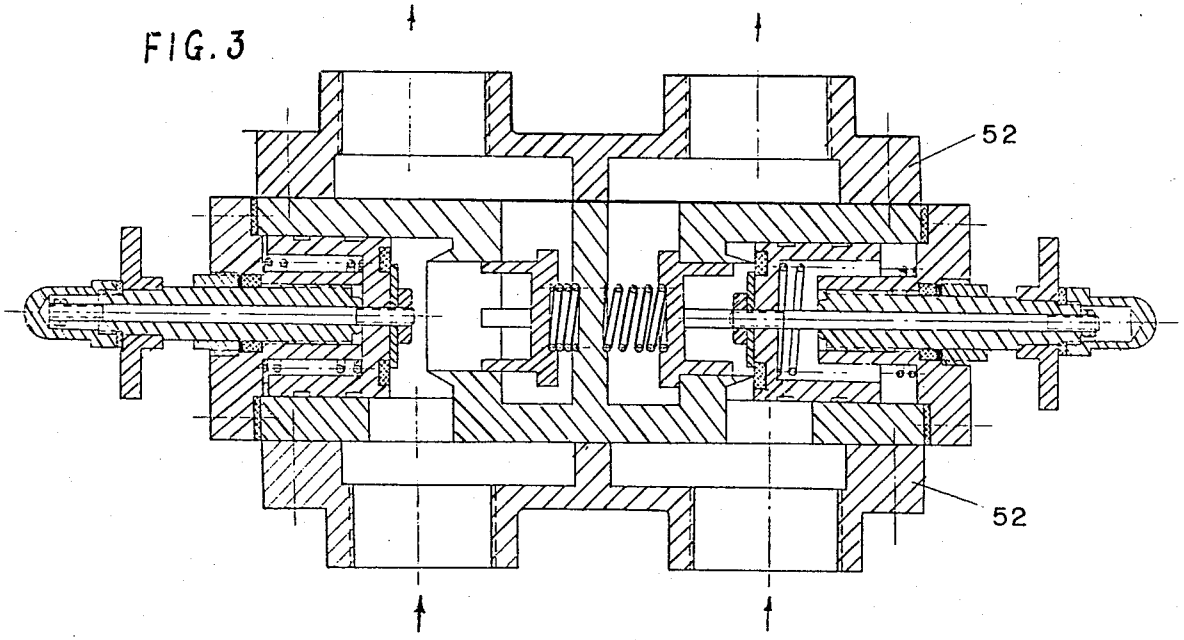
FIG. 3 is a section view of the electromagnetic valve assembly according to the present invention with two electromagnetic valves and the connectors to form the combination of separate inlets and exits opposite each other.
Figure 4:
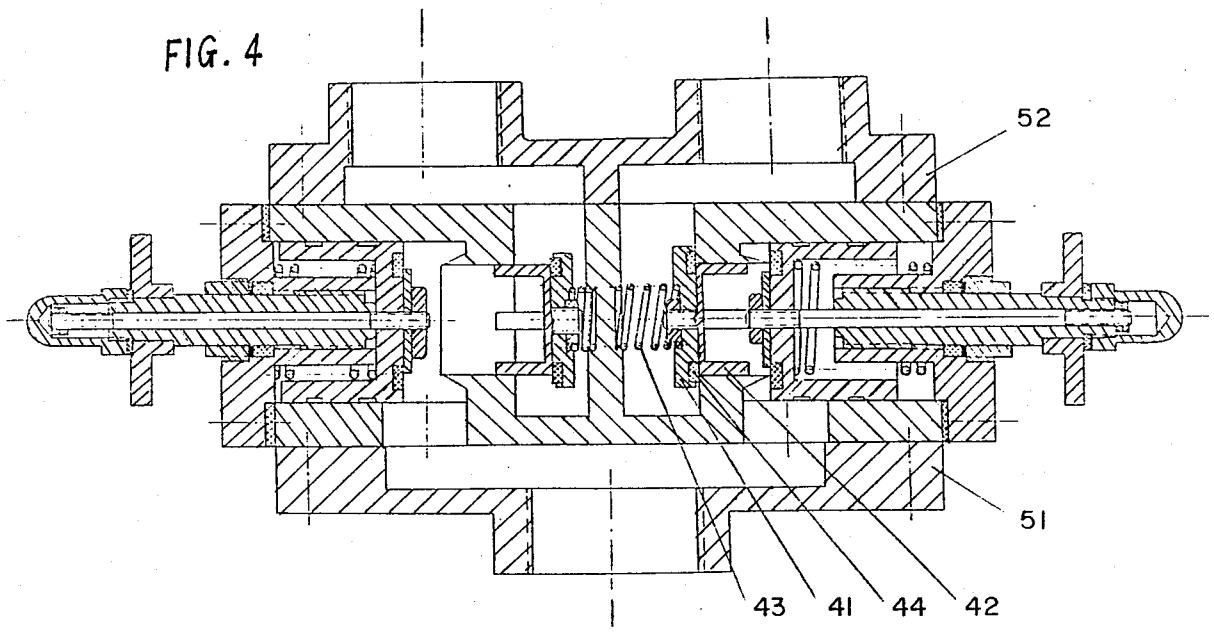
FIG. 4 is a section view of the electromagnetic valve assembly according to the present invention with two electromagnetic valves and connectors to form a combination of a co-inlet and separate exits.
Figure 5:
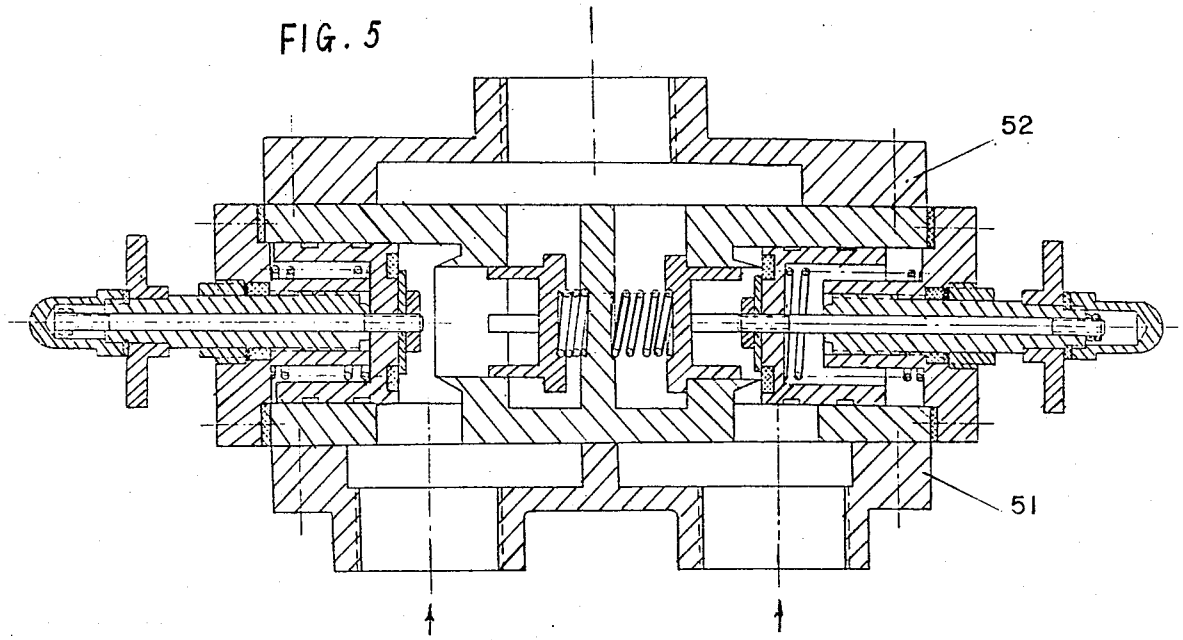
FIG. 5 is a section view of the electromagnetic valve assembly according to the present invention with two electromagnetic valves and connectors to form the combination of a co-exit and separate inlets.

According to the present invention, only two electromagnetic valve assemblies added respectively upstream and downstream of the spiral tube are needed as shown in FIG. 2. A first assembly upstream of the heat exchanger is of the combination of separate inlets and a co-exit as shown in FIG. 4. A second assembly downstream of the heat exchanger is of the combination of a co-inlet and separate exits as shown in FIG. 5.

Figure 10:
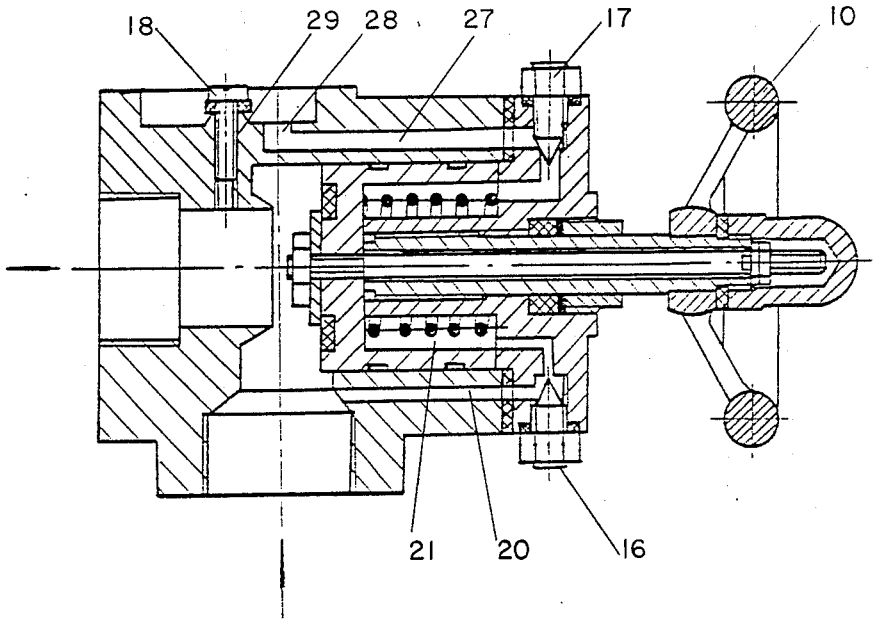
FIG. 10 is a partial sectional view of the electromagnetic valve assembly shown in FIG. 2 in which a threaded plug is fixed at the exit of the pilot valve and the valve is controlled by the manual unit.

Now referring to FIG. 2, the multi-function electromagnetic valve assembly comprising two manual mechanisms, two one-way valves, two throttling mechanisms, and two pilot type electromagnetic valves is shown. In particular, a single housing 1 is provided for two electromagnetic valves. Each electromagnetic valve comprises housing 1, valve piston 2, pressure spring 3, valve cover 4, and a pilot valve controlled by an electromagnetic operating unit 30., etc. The inlet passage and exit passage of the pilot valve are usually formed in housing 1. Pilot valve exit 29 communicates with the main valve exit 26, and a throttling mechanism is provided at the second passage 27 between pilot valve inlet 28 and main valve back chamber 21. As shown in FIG. 10, the pilot valve exit 29 is threaded to accept a threaded plug 18 which can be used when the electromagnetic operating unit 30 is to be removed.

The throttling mechanism is composed of a passage hole and adjusting screw 17 which has a tapered end, mounted on the valve cover 4. Also, in the first passage 20 between main valve back chamber 21 and main valve inlet 22, another throttling mechanism is provided with the same structure of the throttling mechanism mentioned above. Two sets of nuts, washers, and sealing rings are provided for sealing and fixing two adjusting screws. Threaded rod 5 with handle 10 is fixed by female thread on the cover 4, the press cover 8, washer 7, and sealing ring 6 are used for sealing between the cover 4 and threaded rod 5. Valve piston 2 is connected and fixed to piston rod 9 by the nut 4. The piston rod 9 extends beyond the end of the threaded rod 5 through an inner hole in the threaded rod 5, with double nut 12 being provided to interlock it. The moving distance of the piston rod 9 relative to the threaded rod 5 is a little bit larger than the desired rated moving distance of the valve piston 2. Rod cover 13 is connected to the outer end of the threaded rod 5 with a threaded end part sealed by sealing ring 11 to prevent media in the assembly from leakage through the inner hole of the threaded rod 5.

At the exit side of the valve hole 24 of the valve housing 1, a one-way valve seating 25 is formed. A one-way valve piston 41 is provided facing the seating of the one-way valve. The one-way valve piston consists of a valve piston bottom disk 42 and a valve piston body which comprises at least three guide vanes 41. The outer surface of the guide vanes 41 guide the valve piston in sliding along the inner surface of valve hole 24. The piston bottom disk 42 may be extended to form the guide vanes, or the piston bottom disk may be connected with the guide vanes. In order to improve sealing, a flexible resin or rubber ring 44 may be used between the guide vanes 41 and the piston bottom disk 42 as shown in FIG. 4. A pressure spring 43 is provided to constantly press the valve piston into a sealing position to prevent back flow.

The operation principle of the multi-function electromagnetic valve assembly shown in FIG. 2 will be described hereinafter. When the pilot valve receives a command to close, media flows through the passage 20 into the outer space of the valve piston 2 into back chamber 21. The valve piston 2 will thus be pressed against the valve seating 23 due to the same media pressure in the back chamber 21 and at inlet 22.

After the pilot valve receives the command and opens, media in the back chamber will flow through guide valve inlets 28 and exit through passage 29 to the main valve exit 26. Because the passage area at the inlet of back chamber 21 is smaller than that at the exit of back chamber 21, media pressure in back chamber 21 would be lower than the pressure at inlet 22, so that the valve piston 2 will move off valve seating 23 overcoming the spring force due to the pressure difference. Then media will exert pressure on the one-way valve piston and then flow to exit 26 through the space between the claw-like parts 41.

When the media pressure at exit 26 is higher than that at inle 22, one-way valve piston will move toward the valve seating and be abutted against the valve seating so that back flow will be stopped.

If necessary to utilize manual operation, each valve can be easily operated by only turning handle 10 by hand in one turning direction corresponding to closing the main valve and in the opposite direction for opening the valve. So the manual operation will not interfere with automatic operation and electromagnetic performance will not be deteriorated, the piston rod can move freely within the inner space of the threaded rod within the rating range. Setting the handle position may also restrict the moving distance when the system is in the automatic operation mode. In this way, the valve displacement is adjustable.

As shown in FIG. 10, when the electromagnetic operating unit needs to be repaired, screw 17 is rotated to close the passage from the back chamber 21 for isolating the pilot valve inlet and a threaded plug 18 is threaded into the pilot valve exit 29 for ensuring sealing of the pilot valve exit. Then the electromagnetic unit can be removed from the assembly and the assembly can still be operated and controlled by the manual unit.

Movement of the main valve is dependent on the media pressure difference acting on the inlet side of the main valve piston 2 and the back side of the main valve piston 2. The response time from the point of receiving a command to reaching the above noted pressure difference can be adjusted by setting two screws 16 and 17 to change the inlet and exit passage agea of the back chamber. As for different media with different viscosity, the pressure difference can reach the desired value by setting the two screws, resulting in improving the compatibility of the electromagnetic valve assembly.

When the outer surface of the valve piston is worn and the gap is too large, compensation can be made by making use of the throttling mechanism to restore the overall inlet area of the back chamber 21 or the area difference between the inlet and exit to the original value. In this way, the life-time of the electromagnetic valve assembly can be improved.

FIGS. 3, 4, 5, and 6 show the multi-function electromagnetic valve assembly according to the present invention with one single housing and only two different inlet and exit connectors forming four different combinations, in which connector 51 has merged passages and connector 52 has separate passages. It should be noted that the inlet connector and exit connector also may be exchangeable with each other. So the combination of the present invention is quite flexible. The form of the connection part of the connector is not limited to only a female thread form, but the embodiments show one possible way to connect it to the pipe.

Figure 7:
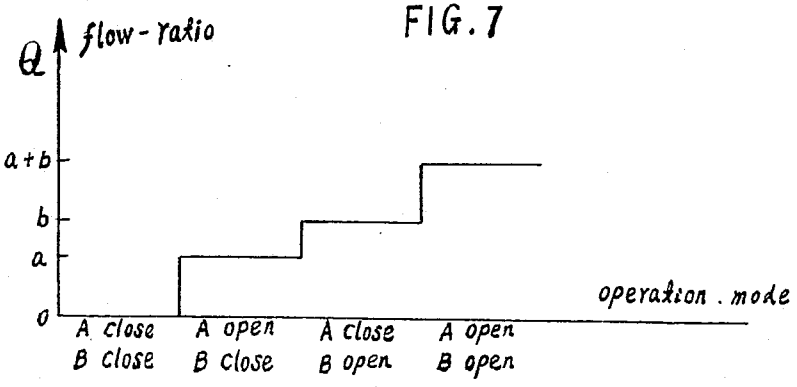
FIG. 7 is a flow-ratio diagram of the assembly mentioned in FIG. 6.
Figure 6:
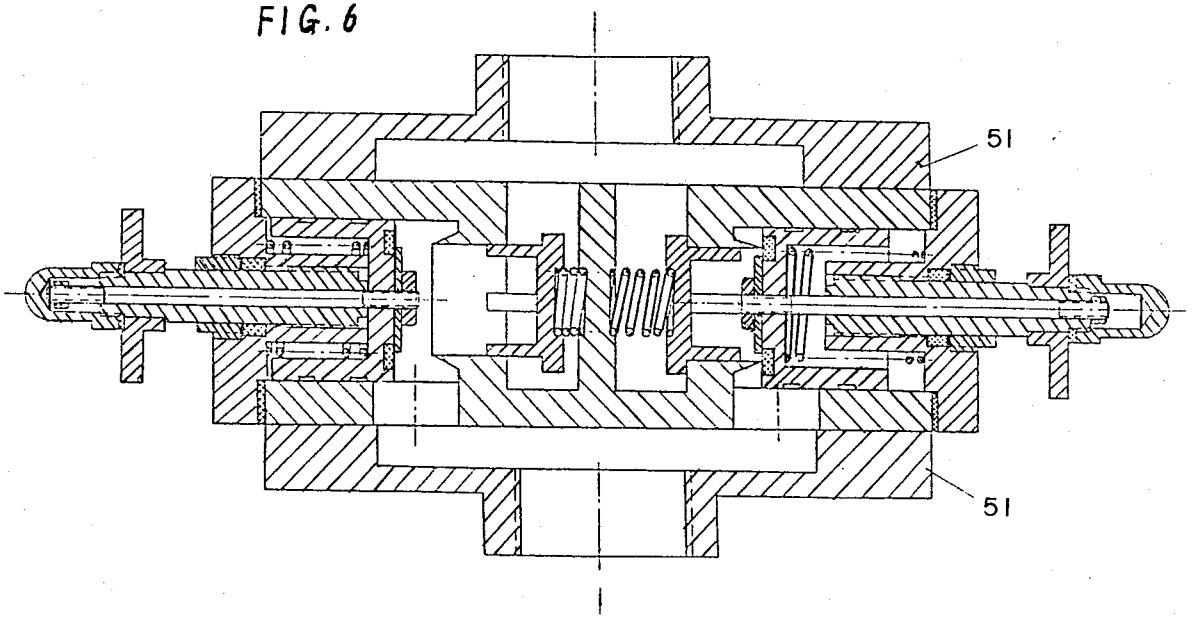
FIG. 6 is a section view of the electromagnetic valve assembly according to the present invention with two electromagnetic valves and connectors to form the combination of a co-inlet and a co-exit.

FIG. 6 shows an electromagnetic valve assembly comprising two main valves, and the value of flow rate of one valve A is a and the other is b wherein the value of a is less than b. When both valves are closed, the flow rate of the system is zero; when valve A is opened and valve B is closed, the flow rate would be a; when valve A is closed and valve B is opened, the flow rate would be b; and when both valves are opened, the flow rate would be a+b. So the control with four different flow rates can be accomplished in this manner. FIG. 7 shows the flow rate change according to different operation modes.

Figure 8:
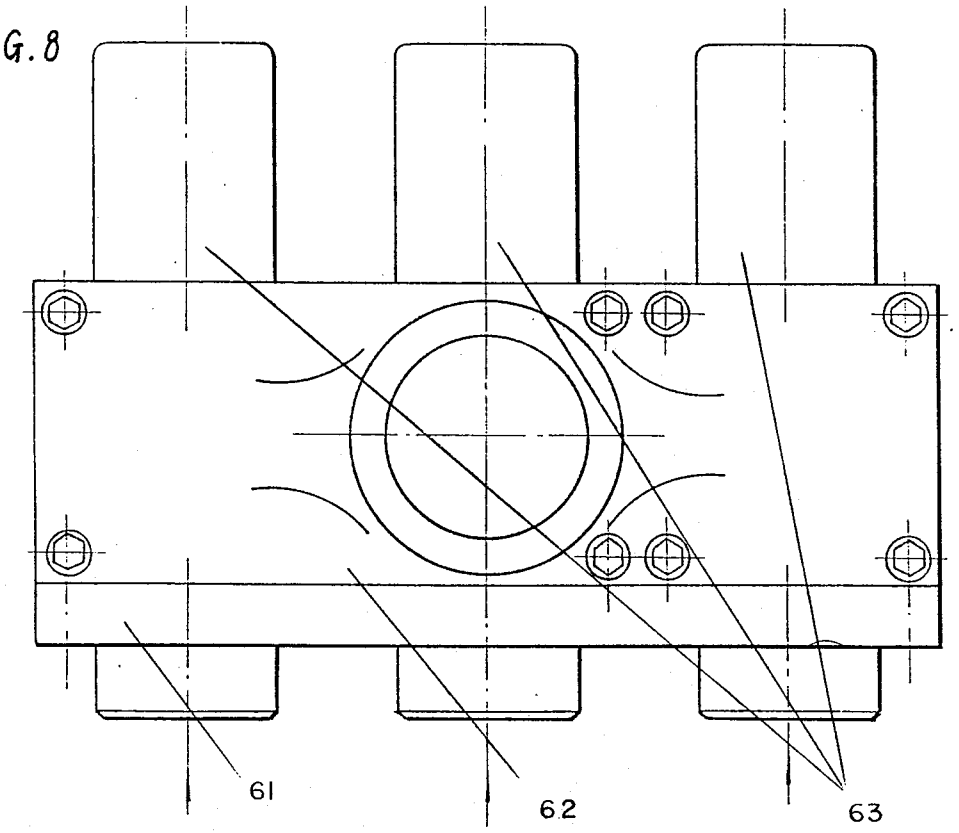
FIG. 8 is an outline of the electromagnetic valve assembly according to the present invention with three electromagnetic valves and three separate inlets and one co-exit.
Figure 9:
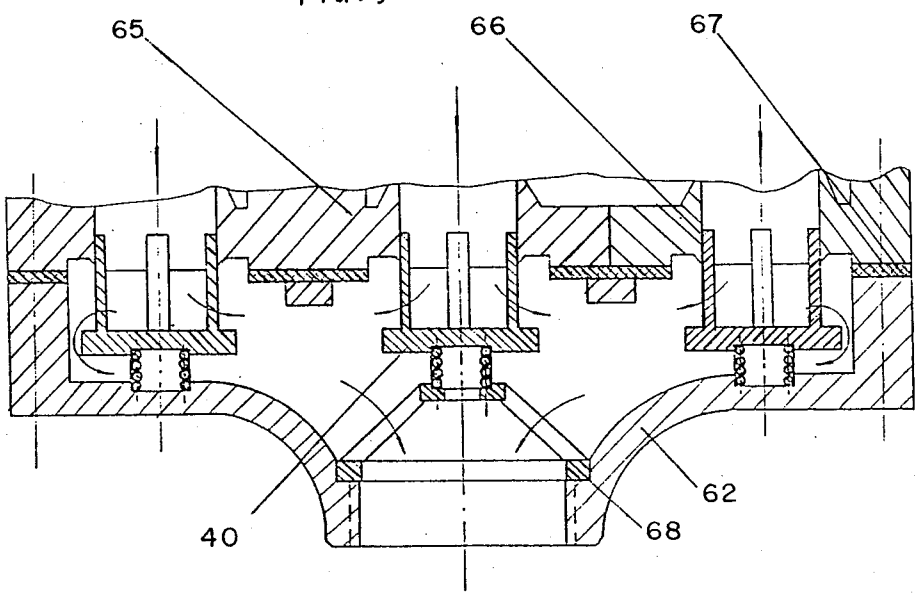
FIG. 9 is a partially enlarged sectional view showing the one-way function of the assembly mentioned in FIG. 8.

Of course, the present invention is not limited to only two electromagnetic valves. For example, the present invention can comprise a number of electromagnetic valves if needed. FIG. 8 shows an electromagnetic valve assembly comprising three electromagnetic valves with their exits and inlets in a perpendicular arrangement and with three separate inlets and one co-exit. FIG. 9 is a partial enlarged sectional view of its exit. The left valve body 65 comprises two electromagnetic valves and the right valve body 66 has only one electromagnetic valve. The valve bodies 65 and 66 are connected together to form a whole assembly by inlet connector 61 and exit connector 62. In FIG. 8 and FIG. 9, numeral 63 stands for three electromagnetic operating units, numeral 40 is a one-way piston, and numeral 68 is a pad seat with web.

The electromagnetic valve assembly can meet the demands of different applications, because of its multi-function capability, compact configuration and the ability to form a variety of combinations. For example, the above multi-pass combination can be used for separately controlling steam and cold water to attain a desired temperature and liquid surface level. The combination with co-exit and separate inlets can be used for controlling cold and hot media to get a desired temperature or for application in a compounding system or mixing system. The combination with co-inlet and separate exits can be used for a distribution system to replace many electromagnetic valves conventionally used in the prior art. The combination with co-inlet and co-exit can be used for controlling a flow rate with satisfactory accuracy. So the multi-function electromagnetic valve assembly according to the present invention can be widely used in many of different fields and can provide the benefit of reducing the amount of investment in a control system while maintaining satisfactory performance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A pilot type electromagnetic valve, said valve comprising:

a valve housing having an inlet and an outlet with an opening having a valve seat disposed therebetween, said inlet extending into a chamber positioned adjacent said valve seat;

main valve means operably disposed within said valve housing cooperating with said valve seat for controlling the flow of media therethrough, said main valve means sealing and dividing said chamber into a main chamber facing said valve seat and a back chamber;

a first passageway fluidly connecting said inlet to said back chamber;

said valve housing being provided with a second passageway connecting said back chamber to said outlet;

a pilot valve means provided along said second passageway for controlling fluid flow through said second passageway and controlling said main valve means, said pilot valve having an electromagnetic operating unit removably conneced to said valve housing;

a first throttle valve provided within said valve housing along said second passageway between said back chamber and said pilot valve means for controlling fluid flow though said second passageway;

a manual operating means connected to said main valve means for providing manual control of said main valve means; and a threaded plug for sealing a portion of said second passageway between said pilot valve means and said outlet wherein said portion of said second passageway is threaded for receiving said threaded plug for ensuring sealing of said portion of said second passageway;

whereby closing said first throttle valve to stop the flow of fluid from said back chamber to said pilot valve means and plugging said portion of said second passageway with said plug permits removal of said electromagnetic operating unit while maintaining operation and control of said valve with said manual operating means.

2. The valve according to claim 1, wherein said valve means comprises a valve piston slidably disposed within said chamber and a spring biasing said valve piston into engagement with said valve seat.

3. The valve according to claim 2, wherein a second throttle valve is provided in said first passageway for controlling fluid flow through said first passageway.

4. The valve according to claim 2, wherein said manual operating means comprises a threaded rod connected to said main valve means and extending out of said valve housing, said threaded rod being positioned substantially parallel with a moving direction of said valve means and actuates said main valve means upon rotation.

5. The valve according to claim 4, wherein said housing has a cover, said cover covering a cavity with said threaded rod extending through a threaded hole in said cover, and including a seal between said cover and said threaded rod.

6. The valve according to claim 4, including a center rod disposed with an inner hole along the length of said threaded rod, said center rod connected at one end to said valve piston and provided at an opposite end with a position limit member, wherein the moving distance of said center rod relative to said threaded rod is longer than the desired rated moving distance of said valve piston, and including a sealing member provided on the end of said threaded rod extending from said valve housing for preventing leakage of media through said inner hole along said center rod.

7. The valve according to claim 1, wherein a second throttle valve is provided in said first passageway for controlling fluid flow through said first passageway.

8. The valve according to claim 7, wherein said first throttle valve comprises a tapered end screw received within a thread opening in said valve housing, said screw cooperating with a passage hole in said second passageway with the flow cross section through said passage hole being adjustable by turning said screw for controlling fluid through said second passageway.

9. The valve according to claim 1, wherein said first throttle valve comprises a tapered end screw received within a thread opening in said valve housing, said screw cooperating with a passage hole in said second passageway with the flow cross section through said passage hole being adjustable by turning said screw for controlling fluid through said second passageway.

10. The valve according to claim 1, wherein said manual operating means comprises a threaded rod connected to said main valve means and extending out of said valve housing, said threaded rod being positioned substantially parallel with a moving direction of said valve means.

11. The valve according to claim 1, including a one-way valve provided at the outlet side of said opening in said valve housing.

12. The valve according to claim 1, wherein said one-way valve comprises a piston bottom disk and a piston body having at least three guide vanes, whereby the outer surfaces of said guide vanes can slide along the inner surface of said opening in said valve housing.

* * * * *